United States Patent [19]

Udagawa

[11] Patent Number: 4,678,449

[45] Date of Patent: Jul. 7, 1987

[54] TRACKWAY TOY ASSEMBLY

[76] Inventor: Yoshio Udagawa, 3-13, 3-Chome, Mama Ichikawa-Shi, Chiba-Ken, Japan

[21] Appl. No.: 825,324

[22] Filed: Feb. 3, 1986

[30] Foreign Application Priority Data

Aug. 31, 1985 [DE] Fed. Rep. of Germany ... 8525183[U]

[51] Int. Cl.[4] ..... A63H 33/26

[52] U.S. Cl. ..... 446/136; 446/171

[58] Field of Search ..... 446/136, 135, 134, 133, 446/137, 138, 139, 129, 171, 172, 168; 272/8 R, 8 D

[56] References Cited

U.S. PATENT DOCUMENTS

| | | | |
|---|---|---|---|
| 1,274,979 | 8/1918 | Bliley | 446/171 |
| 2,282,430 | 5/1942 | Smith | 446/136 X |
| 2,402,949 | 7/1946 | Carmichael, Sr. | 446/138 |
| 2,975,551 | 3/1961 | Oberinger | 446/135 |
| 4,091,561 | 5/1978 | Kimura | 446/171 X |

*Primary Examiner*—Mickey Yu

*Attorney, Agent, or Firm*—Darby & Darby

[57] ABSTRACT

A trackway toy assembly includes a plate-like member, a plurality of toy pieces in the shape of dolphins or other animals, which can be attracted by a magnetic force, a trackway with two ends for the toy pieces to slide along, mounted on the front-face of the plate-like member, a circular member rotatably mounted on the fear face of the plate-like member and a plurality of magnet elements mounted on the circular member at equal intervals. The toy pieces are attracted by the magnet elements and move from one end of the trackway to the other end, appearing from a distance to make a jumping-like motion which is appealing and amusing to children.

4 Claims, 5 Drawing Figures

TRACKWAY TOY ASSEMBLY

BACKGROUND OF THE INVENTION

This invention relates to a trackway toy assembly including a dolphin or animal image capable of two types of movement, and in particular concerns new and useful improvements on a trackway toy assembly, including a novel magnet means which attracts the animal image causing it to make a jumping motion considered to be extremely appealing and amusing to children.

An animated track toy means a toy that includes a track and several objects which perform movement in conjunction with the track, generally through the utilization of a battery driven motor.

Many of the known designes of track toy sets used today are in a climbing and sliding, or raising and sliding arrangement in which an moving animal image can be elevated up a stairway step by step in such a manner that it appears as if it is climbing the stairway. When the animal image reaches the top step of the stairway, it will slide on a slideway engaged with the stairway down to the bottom of the toy.

In this kind of trackway toy set, the stairway or any other raising members which work the moving animal image are exploded and visible on the outside, so that the children's interest may decrease after playing over a a period of time.

Some kinds of animals jump or fly from place to place, according to their natures, but it is difficult to represent this kind of motion in the above-described arrangement where the staircase or elevating elements are exploded on the outside.

In the present invention, a trackway toy assembly with simple and novel construction is disclosed, which is believed to be extremely appealing to children.

SUMMARY OF THE INVENTION

With the above disadvantages in mind, the general object of the invention is to provide a trackway toy assembly which is simple in construction, and more appealing and amusing to children.

Another object of this invention is to provide a trackway toy with a novel and interesting structure.

According to the features of the present invention, a trackway toy assembly includes a support having a plate-like member, a toy piece which can be attracted by a magnetic force, and a trackway along which the toy piece can slide, mounted on the support and which has a portion extending along the front face of the plate-like member. This portion has a gap between a first end and a second end of the trackway which prevents the top piece from sliding continuously round the track, the first end being higher than the second end. A circular member is rotatably mounted on the rear face of the plate like member and a plurality of magnet elements are mounted on the periphery of the circular member, and are spaced at equal intervals from each other. An electric driving means is connected to the circular member so as to move the plurality of magnet elements along the other face of the plate-like member thereby carrying the toy piece through the gap by magnetic attraction, so that it appears that the toy piece is jumping from the second end to the first end along a curved route. The plate-like member further includes a U-shaped member having two ends attached to the front face thereof at a location through which the route passes.

By the above-described arrangement, the toy pieces, shaped for example like dolphins, which are at the second end of the trackway, are each in turn attracted through the plate-like member by one of the magnet elements on the other side of the plate-like member, and follow the rotational movement of the magnet elements. The toy piece thus passes through the U-shaped member at the uppermost point of the circle described by the magnet elements and the toy piece. After passing through the U-shaped member, the toy piece reaches the first end of the trackway, slides down along the trackway and returns to the starting point, which is the second end of the trackway, and waits for one of the rotating magnet elements to reach the starting point. The magnet element continues its rotation after the toy piece has moved from the front surface of the plate-like member to the first end of the trackway, and thus it also returns to the starting point, where it will attract a toy piece and begin the rotational pattern again.

DETAILED DESCRIPTION OF THE PREFERRED EMBODIMENT

Figure 1:
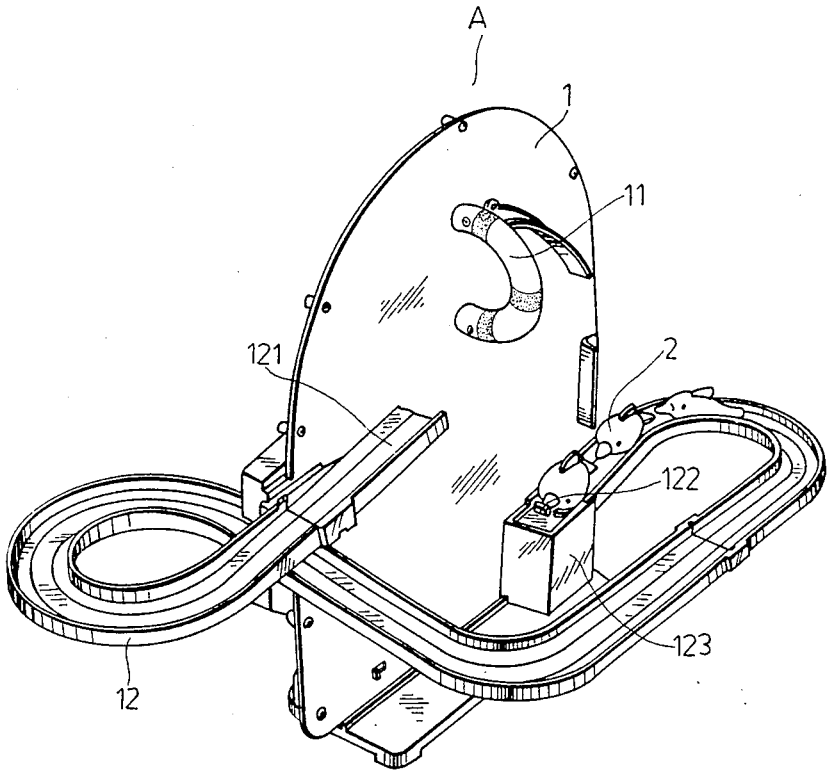
FIG. 1 is a perspective view of an embodiment according to the present invention.
Figure 2:
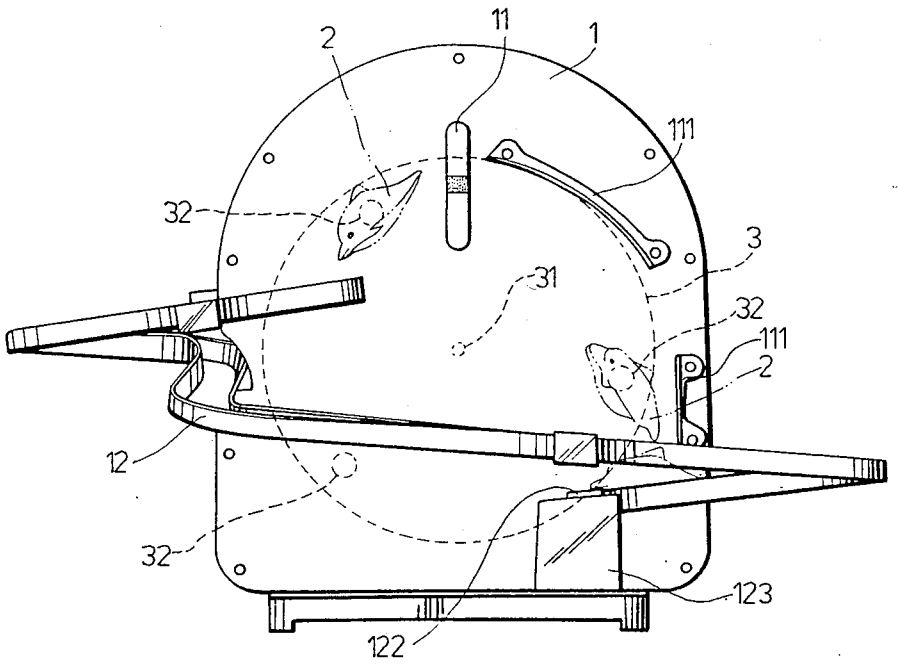
FIG. 2 is a front view of the embodiment showing the toy pieces moving from one end of the trackway to the other end of the trackway as if it is in jumping motion according to the present invention.
Figure 3:
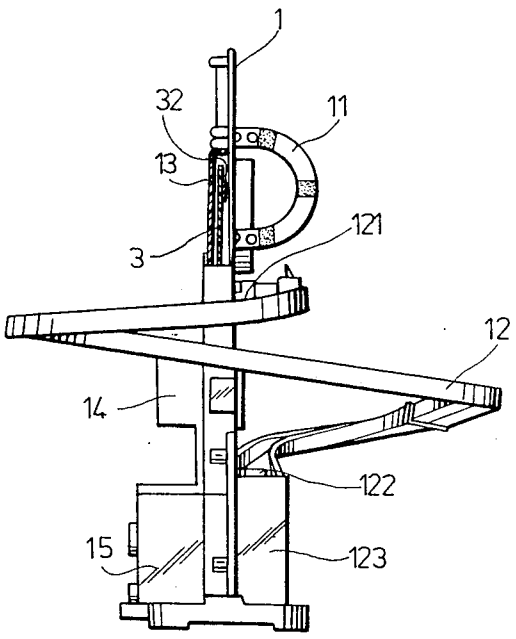
FIG. 3 is a side view of the embodiment showing an exploded portion according to the present invention.
Figure 4:
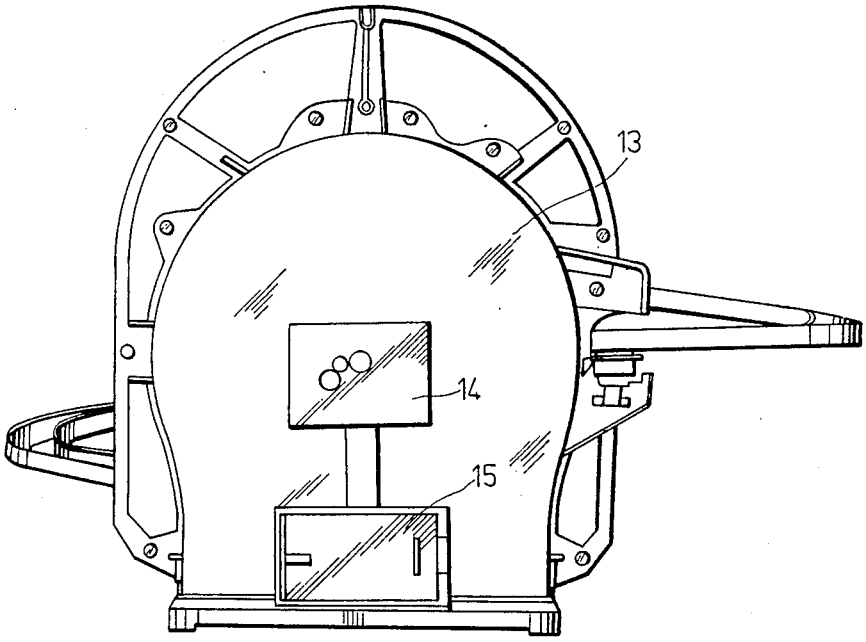
FIG. 4. is a rear view of the embodiment according to the present invention.

The following is a detailed description of the best presently comtemplated embodiment of the invention. This description is not to be taken in a limiting sense, but is made merely for the purpose of illustrating the general principles of the invention.

Referring to FIG. 1, FIG. 2, FIG. 3 and FIG. 4, an embodiment of the present invention includes a support A having a plate-like member 1, a plurality of toy pieces 2 in the shape of dolphins which can be attracted by a magnetic force, a trackway 12 for the toy piece 2 to slide along mounted on the support A and having a portion extending along the front-face of the plate-like member 1. The extended portion has a retarding gap between a first end 121 and a second end 122 of the trackway 12 prevents the toy piece 2 from sliding continuously round the trackway 12. The first end 121 is higher than the second end 122, and the support A further includes a seat 123 formed on the base of the support A for supporting the second end 122 of the trackway 12.

A circular member 3 is rotatably mounted on the rear face of the plate-like member 1 and a plurality of magnet elements 32 are mounted on the periphery of the circular member 3 and are spaced at equal intervals from each other with an angular distance of 120 degrees. The support A further includes a housing 13 mounted on the rear face of the plate-like member 1. The circular member 3 is placed in the housing 13. An electric driving means 14 including a motor and rotating gear arrangement (not shown in the figure) in the centre of th housing 13 is connected to the circular member 3 through a pivot 31, so as to move the plurality of the magnet elements 32 over the other face of the plate-like member 1 in order to attract the toy pieces 2 magnetically, and carry the toy pieces 2 across the gap from the second end 122 to the first end 121, such that when seen from a distance, the toy pieces 2 appear to be making a jumping-like motion along a curved route. The electric driving means 14 can be energized by the power source of battery 15. The electric driving means 14 and the battery 15 are each placed in a separate housing each of which is integrally built with the housing 13. The circular member 3, the magnet elements 32 and the electric driving means 14 are placed in the housing 13 so that they cannot be seen from the outside of the toy assembly.

The plate-like member 1 further includes a U-shaped member 11 in the shape of a hoop having two ends attached to the front face thereof at a location through which the route passes. The plate-like member 1 still further includes two guide means 111 projecting from the front-face of the plate-like member 1 which guide the toy piece 2 along its route through the U-shaped member 11.

By the above-described arrangement, the toy piece 2 at the second end 122 are each in turn attracted through the plate-like member 1 by one of the magnet elements 32 on the other side of the plate-like member 1, and follow the rotational movement of the magnet elements 32. The toy piece 2 thus passes through the U-shaped member 11 at the uppermost point of the circle described by the magnet elements 32 and the toy piece 2, the toy piece 2 being guided through the U-shaped member 11 by the guide means 111 which follows the line and shape of the upper right section of the circumference of the circular member 3. This above-described motion, which appears like a dolphin jumping through a hoop, is most appealing to children. After passing through the U-shaped member 11, the toy piece 2 reaches the first end 121 of the trackway 12 and slides down to the starting point or the second end 122 of the trackway 12, where the toy piece 2 waits for one of the rotating magnet elements 32 to reach the starting point. The magnet element 32 continues its rotation after the toy piece 2 has moved from the front-face surface of the plate-like member 1 to the trackway 12, and thus also returns to the starting point or the second end 122 of the trackway 12, where it will attract another toy piece 2 and begin the rotational pattern again. The cycle will be repeated automatically so long as the toy assembly is being operated.

Figure 5:
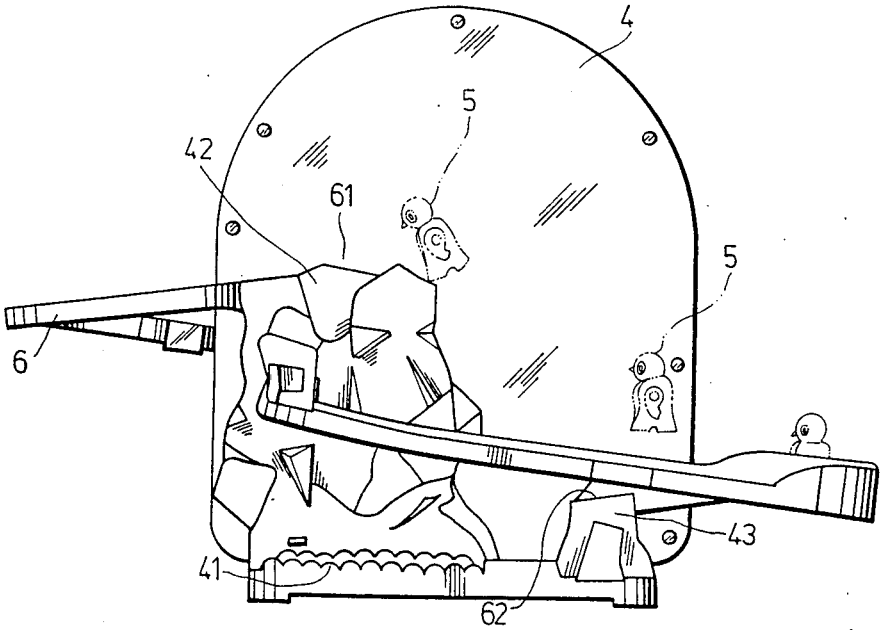
FIG. 5 is a front view of an another embodiment according to the present invention.

FIG. 5 is an another embodiment of the present invention which includes a plate-like member 4, a plurality of penguins 5 and a trackway 6. The plate-like member 4 further includes an ice-rock design 61, 62 and sea wave 41 painted under the ice rock 61 as a decoration on the front-face surface of the plate-like member 4. The trackway 6 includes a first end 61 which stands on the ice rock 61 and a second end 62 which stands on the ice rock 62. When the toy assembly is operated, the toy piece in the shape of penguin 5 is attracted by the magnet elements so that it makes a jumping motion from the ice rock 62 to the ice rock 61 and then slides down.

While the invention has been described with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures.

I claim:

1. A trackway toy assembly, which comprises:

a support having a plate-like member, the plate-like member including a viewable front face and a rear face opposite the viewable front face;

at least one movable toy piece which can be attracted by magnetic force;

an interrupted trackway for the toy piece to slide along, the trackway being mounted on the plate-like member, the trackway having a first end and a second end, the first and second ends being disposed on the viewable front face of the plate-like member, the first end being disposed at a level which is lower than that at which the second end is disposed so that the trackway slopes downwardly from the second end to the first end and so that the toy piece is adapted to slide along the trackway from the second end to the first end, the first and second ends defining a gap therebetween situated on the viewable front face of the plate-like member;

at least one magnetic means for magnetically attracting the toy piece; and a rotatable circular member disposed on the rear face of the plate-like member and rotatable with respect thereto, the one magnetic means being mounted to the rotatable circular member and movable in a circular path therewith, the first and second ends of the interrupted trackway being further disposed along the circular path of the magnetic means, wherein the toy piece is adapted to be attracted to and carried by the magnetic means from the first end of the trackway to the second end in a circular motion upon rotation of the circular member, to give the impression that the toy piece is jumping across the gap from a lower level to a higher level, and wherein upon reaching the second end, the toy piece slides along the trackway from the second end to the first end.

2. A trackway toy assembly as defined by claim 1, wherein the rotatable circular member has a plurality of magnetic means mounted thereon near a peripheral edge of the circular member and movable in the circular path, the magnetic means being separated from each other at equal intervals along the peripheral edge of the circular member.

3. A trackway toy assembly as defined by claim 1, which further includes a U-shaped member having two ends attached to the viewable front face of the plate-like member, the U-shaped member being disposed on the front face along the circular path, and defining an opening through which the toy piece passes as the piece is carried by the rotatable circular member.

4. A trackway toy assembly as defined by claim 1, which further includes guide means mounted on the front face of the plate-like member and disposed thereon adjacent the circular path for guiding the toy piece along the circular path.

* * * * *